US006237670B1

(12) United States Patent
Muschio

(10) Patent No.: US 6,237,670 B1
(45) Date of Patent: May 29, 2001

(54) TREATMENT OF THERMOPLASTIC MATERIALS WITH CHELATING AGENTS, AND RELATED PRODUCTS

(75) Inventor: Henry M. Muschio, Pawling, NY (US)

(73) Assignee: M. Argueso & Company, Inc., Mamaroneck, NY (US)

( * ) Notice: Subject to any disclaimer, the term of this patent is extended or adjusted under 35 U.S.C. 154(b) by 0 days.

(21) Appl. No.: 09/659,997

(22) Filed: Sep. 12, 2000

Related U.S. Application Data

(60) Provisional application No. 60/162,528, filed on Oct. 29, 1999.

(51) Int. Cl.[7] ..... B22C 9/00

(52) U.S. Cl. ..... 164/15; 106/38.8; 164/520; 210/696; 210/698; 210/777; 264/221; 523/139

(58) Field of Search ..... 164/15, 520, 524; 106/38.8, 191; 210/696, 698, 777, 778; 264/221, 328.17; 523/139, 141, 332

(56) References Cited

U.S. PATENT DOCUMENTS

| | | | | |
|---|---|---|---|---|
| 4,144,075 | * | 3/1979 | Koenig | 106/38.8 |
| 5,518,537 | * | 5/1996 | Muschio | 106/191 |
| 5,573,055 | * | 11/1996 | Melling et al. | 164/15 |
| 5,697,043 | * | 12/1997 | Baskaran et al. | 419/30 |
| 6,051,619 | * | 4/2000 | Brandt | 521/93 |

* cited by examiner

*Primary Examiner*—Peter A. Hruskoci
(74) *Attorney, Agent, or Firm*—Howell & Haferkamp, L.C.

(57) ABSTRACT

The metal content of a thermoplastic composition containing an undesirably high concentration of metal can be reduced by adding to 100 parts by weight of the composition at least about 0.3 parts by weight of a chelating agent and sufficient water to chelate metal in the composition to form chelated metal in the composition, and then removing at least some of the chelated metal from the composition.

15 Claims, No Drawings

TREATMENT OF THERMOPLASTIC MATERIALS WITH CHELATING AGENTS, AND RELATED PRODUCTS

This application claims priority to provisional application Ser. No. 60/162,528, filed on Oct. 29, 1999.

BACKGROUND OF THE INVENTION

1. Field of the Invention

The present invention relates to pattern-forming compositions, and more particularly to treatment of pattern-forming thermoplastic compositions that are useful in investment casting that contain undesirably high concentrations of metal, and to investment casting methods employing such compositions.

2. Description of the Prior Art

Various investment casting processes, also known as lost wax processes, have been known for centuries. Through the ages, compositions for the construction of disposable patterns used in such processes have been selected for several characteristics, including such important properties as dimensional reproducibility and the ability to produce a highly accurate surface finish in the molded disposable pattern. Because such properties are critical to many products manufactured by lost wax processes, repeated efforts have been and are being made to improve such properties of pattern-forming compositions.

The quality and properties of an investment casting depend inextricably upon the quality of the disposable pattern, which, in turn, depends upon the characteristics of the pattern-forming compositions of which the disposable patterns are molded. Many thermoplastic pattern compositions have been used or suggested for use in the past. As the name "lost wax" process implies, waxes, such as natural waxes, including beeswax and the like, were originally used as thermoplastic pattern materials. As other pattern materials were sought to improve the properties of disposable patterns, other natural thermoplastic materials, such as gum damar, gum rosin, esparto waxes, and the like, mineral waxes, such as those extracted from soft coal, and the like, and petroleum waxes were adopted for use.

As a result of this search, modified waxes, such as microcrystalline waxes, were developed for use in lost wax processes. More recently, as a result of the continuing efforts of researchers to improve upon and to develop new thermoplastic materials, synthetic thermoplastics have been used as pattern materials or as thermoplastic pattern forming composition modifiers. Those efforts have also resulted in the use by some investment casters of materials other than thermoplastic pattern materials, such as mixtures of metallic salts and mercury.

Disposable thermoplastic patterns are usually formed by heating and melting a thermoplastic composition which is adapted to form a pattern, introducing the molten composition into a mold, and then cooling the composition until it solidifies to form a disposable pattern. As used herein, "melting" of a thermoplastic composition refers to melting the thermoplastic thereof such that the composition becomes fluid even though it may still contain, for example, unmelted solid particulate filler dispersed therethrough. For example, such compositions typically contain solid filler materials. A "filler" is an inert additive in the sense that it does not react chemically with the thermoplastic through which it is dispersed. The filler remains a separate phase and retains its identity throughout the investment casting process. Conventionally, fillers have been solid particulates that are dispersed throughout a continuous phase of the thermoplastic material. Among the filler materials that have been included in minor quantities in thermoplastic pattern-forming compositions may be noted thermoplastic or thermosetting polystyrene powder, especially polystyrene cross-linked with divinylbenzene, and urea powder. U.S. Pat. No. 5,270,360 discloses the use of finely divided poly (methylmetha-crylate) as a filler. Organic acids, such as fumaric acid, adipic acid and isophthalic acid, have also sometimes been used as fillers, usually in amounts of up to 50% by weight of the thermoplastic pattern-forming composition, and in a particle size generally from about 175 to about 250 mesh. Thus, for a typical filler, at least about 90%, preferably 100%, by weight of the particles may pass through a 100-mesh sieve and at least about 50%, preferably about 50%, by weight of the particles pass through a 200-mesh sieve.

Thus, ideal fillers for pattern-forming compositions would provide high thermal conductivity, aid the composition in flowing out of a mold quickly prior to thermal expansion that can cause shell cracking, aid the composition in flowing out of the shell more completely, leave minimal, if any, ash residue in the mold, and result in patterns with smooth surfaces and less shrinkage. Of course, an ideal filler also would be readily available and low cost.

After the disposable thermoplastic pattern is formed, it is removed from the mold, assembled with other patterns, if necessary, and then encased in a mold forming a ceramic material, applied as an aqueous slurry in accordance with one of a variety of known methods, thereby forming a shell or cast about the disposable pattern.

Next, upon hardening of the ceramic, a major portion of the disposable pattern is removed by melting at a moderately elevated temperature by autoclaving, with substantially all of the remainder of the pattern material being removed at a substantially higher temperature by vaporization or burning or both so that, except for any ash residue from the pattern material, the inner surface of the shell or mold is clean. The shell or mold is then ready for a one-time use for forming an investment cast part. A text describing known procedures used in lost wax processes is entitled Investment Casting, H. T. Bidwell, Machinery Publishing Co., Ltd., England, 1969.

By this process, the surface characteristics of the disposable pattern and of the ceramic shell are "transferred" to the final casting. Thus, the above-discussed properties of the pattern-forming composition and any residue therefrom will affect the surface characteristics and metallurgical characteristics of a casting.

Since the pattern material is evacuated by heat and pressure in an autoclave or removed by other methods, such as what is referred to as "flash de-waxing," some residual pattern materials stay behind in the shell, trapped by the configuration of the pattern material, or not liquefied. The remaining wax that is absorbed by the shell and that pattern material that is trapped must be removed at a much higher temperature in what is referred to as a preheat furnace. The preheat ovens in addition to vaporizing the remaining pattern material also preheats the ceramic shall prior to introducing molten metal into this ceramic shell as to avoid the metal from freezing and allowing the molten metal to fill the cavity.

At this step, inorganic impurities contained in the pattern material are reduced to their oxides. The inorganic materials may consist of iron, calcium, and sodium to name a few. When the shell is preheated, if the pattern materials contain these and other inorganic materials, ash from such impurities may be left in the shell.

While the present of ash is, in and of itself, undesirable, the nature of the ash residue is also significant. An ash that is light, puffy and floats away easily with air currents does not create nearly the problem an unctuous or a hard ash that sticks to the inner surface of the shell or mold does. Of particular difficulty is an ash that can result from a high metal content, such as a high iron content, in the thermoplastic composition. When such compositions are heated, the metal tends to form an oxide, which shows up as a glazed ash that is hard and strongly adhered to the inner surface of the shell or mold. The presence of such ash in the shell or mold will, of course, produce a corresponding defect in the surface of the cast part. Therefore, a method is desired for reducing the metal content in the thermoplastic composition, and thereby reducing the amount of such metal oxide ash produced in the shell or mold.

SUMMARY OF THE INVENTION

Briefly, therefore, the present invention is directed to a novel method for reducing the metal content of a thermoplastic composition containing an undesirably high concentration of metal. The method comprises adding to 100 parts by weight of the composition at least about 0.3 parts by weight of a chelating agent and sufficient water to chelate metal in the composition to form chelated metal in the composition, and then removing at least some of the chelated metal from the composition.

The present invention is also directed to a novel method for reducing ash formation during an investment casting process with a thermoplastic composition containing metal. The method comprises adding to 100 parts by weight of the composition at least about 0.3 parts by weight of a chelating agent and sufficient water to chelate metal in the composition to form chelated metal in the composition, removing at least some of the chelated metal from the composition to produce a thermoplastic composition of reduced metal content, injecting the thermoplastic composition of reduced metal content into in a mold to form a cast, which is then used for form a shell for forming an investment cast part.

Among the several advantages found to be achieved by the present invention, therefore, may be noted the provision of a method that reduces the ash content of thermoplastic compositions; the provision of such method that not only reduces the ash content, but also improves the quality of the reduced amount of ash; and the provision of such method that reduces the ash and improves the quality of thermoplastic compositions of especially high ash and metal content.

DESCRIPTION OF THE PREFERRED EMBODIMENTS

In accordance with the present invention, it has been discovered that a thermoplastic pattern-forming composition containing an undesirably high concentration of metal such as iron can be treated to reduce the metal concentration to a more acceptable level by adding to the composition enough of a chelating agent to correspond to a concentration of from about 0.3% to about 0.6% based on the weight of the composition and enough water to chelate metal in the composition to form chelated metal in the composition, and then removing at least some of the chelated metal from the composition. It has been found that such treatment not only reduces the amount of ash formed, but also causes what ash does form to be of the light and fluffy type instead of the unctuous or hard and adhering type. In fact, the method of his invention is so surprisingly effective in reducing substantial levels of impurities or at east their deleterious effects that reclaimed wax and other thermoplastic compositions conventionally seen as too impure or "dirty" to be used for investment casting can be treated to produce a pattern material of high quality.

This technique represents a dramatic improvement over earlier techniques. When used pattern materials are returned for reclaiming, the chelating agent such as ammonium citrate may be introduced into the returned pattern material, which typically contains water in either emulsified or unemulsified forms, or both. However, the chelating agent, once in the pattern material, must be accompanied by a minimum amount of water, at least in unemulsified form. The minimum amount of such water will be discussed and defined below. To achieve this minimum water content in the pattern material if it is not present already, water may simply be added with the chelating agent to the water-containing returned wax or, preferably, the existing water in the returned wax may be eliminated by standard techniques (e.g., autoclaving) and then the entire desired water content may be added with the chelating agent. By this latter technique, the water concentration may be controlled more closely.

The method of this invention, therefore, achieves far better and more useful pattern material, particularly in reclaiming pattern material for re-use. Pattern material returned for reclamation contains greater amounts of inorganic by-products from the water treatment chemicals used in the autoclave and iron pick up from the iron shell that the virgin pattern material comes into contact with during pattern removal.

By a "thermoplastic pattern-forming composition," what is meant is a thermoplastic composition suitable for casting thermoplastic patterns in investment casting. The present invention has been found to be so effective in removing certain especially undesirable impurities, such as metals, that waxes and other thermoplastics containing such high levels of such impurities that they have been considered unsuitable for investment casting can be treated to produce thermoplastics with superior investment casting characteristics. Thus, in general, the thermoplastic compositions treated by the methods of this invention comprise a continuous phase of a thermoplastic material through which may be dispersed any of a variety of impurities, or a combination of impurities, including one or more metal. Typically, the metal concentration is so high that even upon treatment with up to 0.15% ammonium citrate, the resulting ash is tinted, such as with a red, pink or greenish tinge. The ash content is generally from about 0.02% to about 0.1% by weight or more. The thermoplastic material may be any of the standard pattern-forming thermoplastic materials. Reclaimed wax is particularly "dirty." That is, it has an especially high level of impurities. In addition, it can have a relatively high level of water, although typically this water is in emulsified form and ordinarily the water content is significantly less than 1% by weight. Those of ordinary skill in the investment casting industry will readily recognize suitable materials. Generally, such materials are solids (although amorphous) at room temperature, but become free-flowing liquids when heated to a temperature between about 50° to about 95° C.

Thus, the terms "organic thermoplastic pattern materials", or simply "pattern materials" or "thermoplastic materials", as used herein refer to natural or synthetic remeltable compositions that comprise a thermoplastic such as wax, any of various thermoplastic polymers, any of various thermoplastic resins or a combination thereof. As noted, such compositions will be readily apparent to those of ordinary skill in the art, and organic thermoplastic materials useful in forming conventional thermoplastic patterns by conventional investment casting techniques are suitable for use in forming the thermoplastic patterns of this invention.

Accordingly, the thermoplastic materials to be treated by the method of the present invention may comprise such conventional thermoplastics as waxes, including natural waxes such as beeswax, other natural thermoplastics, including gum damar, gum rosin, esparto waxes and the like, mineral waxes and petroleum waxes, modified waxes such as microcrystalline waxes, and synthetic thermoplastics.

The thermoplastic composition may therefore be treated according to the method of the present invention as follows. Fillers, if present, may be removed by standard techniques. The thermoplastic composition may also be heated to remove water, but such pre-dehydration is not essential or even necessarily desired. The chelating agent then may be added to the thermoplastic composition, most desirably in combination with water. In fact, it has been found that the presence of water in unemulsified state is essential to the chelation. Thus, even when a wet (i.e., high water content), high metal content thermoplastic, such as reclaimed wax, is treated, it has been found that increasing the concentration of the ammonium citrate, which has been used as additive and can be employed as the chelating agent in the method of the present invention, above 0.15% by weight has not resulted in the degree of metal removal necessary for such high metal content thermoplastics. It is now believed that this failure is based on the need for even higher water concentrations, particularly of water in a non-emulsified state. More specifically, for example, a water content (especially non-emulsified or "free" water content) of at least about 1% by weight should be used, and preferably the water content should be about 2% by weight. Although there is no theoretical upper limit to the water concentration, excess water must be removed prior to use in investment casting and so it is preferred that not much more than the minimum necessary for the degree of chelation desired be used.

It is believed that any agent capable of chelating the undesirable metal or metals, particularly iron (especially in the form of the ferric ion), in the thermoplastic composition may be the chelating agent, although it is preferred that the chelating agent not contain a metal ion: that is, that the agent be metal-free to that any excess chelating agent does not contribute to the metal problem. Especially desirable chelating agents are sufficiently non-basic to avoid—or otherwise avoid—precipitation of metal hydroxides, such as iron hydroxides, that may be formed during chelation.

A particularly desirable chelation agent has been found to be ammonium citrate, dibasic (referred to herein simply as ammonium citrate). Citrates contain a hydroxyl function and three carboxylic acid groups, both of which (hydroxyl functions and carboxylic acid groups) are known to participate in binding metal ions to keep them in solution. Thus, citrates in aqueous solution are capable of forming, with metal ions, coordination complexes that allow the metal to stay in solution. Ammonium citrate is well suited to ferric ion chelation because the ferric ion is highly electronegative and so induces dissociation of the hydroxyl group. The hydroxyl group then participates in the sequestering of the iron and the remaining carboxyl groups are available to chelate with other metal ions. Although citrates also chelate ferrous ions, chelation of ferrous ions probably does not involve the hydroxyl portion of the citrate ion. In ammonium citrate, two of the three carboxylic acid groups are neutralized with the ammonium ion. Aqueous solutions of ammonium citrate are thus approximately neutral in pH and the presence of the hydrogen and ammonium ions act in concert to buffer the solution. Because the competition for the carboxylic acid sites between the hydrogen ions and the metal ions is diminished by the presence of the ammoniumn ion, ammonium citrate allows excellent chelation compared to that noted with citric acid.

Ammonium citrate is well suited to iron chelation for another reason as well. As with many chelating agents, citrates have acidic groups for which hydrogen ions compete with the metal ions. The efficacy of chelation, therefore, increases with increasing pH without the formation of insoluble hydroxides, although the neutral pH provided by ammonium citrate is not alkaline enough to cause precipitation of insoluble iron hydroxides.

The water may be added separately from the chelating agent (in such case preferably simultaneously therewith), although most preferably, the chelating agent is dissolved in the water and the resulting aqueous mixture is added to reclaimed pattern materials. Prior to the addition of the water and chelating agent, reclaimed pattern material can be processed to remove water and all filler material leaving de-watered basic non-filled pattern material to the thermoplastic composition. Preferably, the chelating agent is mixed with just enough water to form a saturated aqueous solution and then the solution is added to the thermoplastic composition. The desirable level of chelating agent in the thermoplastic composition has been found to be about 0.3% to about 0.6% by weight. Thus, for 10,000 pounds of thermoplastic composition, about 30 to about 60 pounds of chelating agent may be used. For ammonium citrate, it has been found that about 10 to about 60 gallons of water, preferably about 15 to about 30 gallons, are sufficient to dissolve the ammonium citrate. The aqueous ammonium citrate solution is then blended with the thermoplastic composition.

The thermoplastic composition thus treated may be processed to eliminate the water by boiling and then passed through a filter press to strip the thermoplastic composition of the chelated metal. Those of ordinary skill in the art of investment casting will readily recognize the types of filter presses that would be suitable. For example, a model M630 FB-24 filter press from Eimco Process Equipment Co. of Salt Lake City, Utah, has been found acceptable.

The filter press may contain diatomaceous earth as a filter aid. However, it has been discovered that if diatomaceous earth is used as a filter aid, traces of the diatomaceous earth, together with remnants of the chelating agent, may be left in the thermoplastic composition. The diatomaceous earth contains inorganic silica, which does not burn cleanly. Therefore, the thermoplastic composition must then be cleaned of the diatomaceous earth. Otherwise, if the thermoplastic composition is used in pattern-forming, the traces of diatomaceous earth remaining in the thermoplastic composition may be left behind in the mold after evacuation of the thermoplastic composition, resulting in defects in products produced from the mold.

On the other hand, it has been found that if cellulose fibers, such as cotton cellulose fibers, are used as the filter aid in the filter press, the fibers not only are effective filter aids, but also—being organic—burn cleanly and as compared to diatomaceous earth. Thus, it is preferable that organic cellulose fibers rather than diatomaceous earth be used as a filter aid. A 100% cotton cellulose fiber sold by Advanced Filtration Co. of New Jersey, USA, under the trade designation CLR-138 has been found to be a cellulose fiber filter aid that is particularly suitable for use in the present invention.

The ash content of the resulting filtered ("cleaned") thermoplastic composition has been found not only to be surprisingly reduced (to a level, for example, of about 0.005% by weight or less), but also to be of the highly preferred light and fluffy variety, without the hard component that tends to adhere tenaciously to the mold surface. Thus, even thermoplastic compositions that begin as extremely dirty and high metal content materials become high quality candidates for investment casting.

The treated composition then can be used in the conventional investment casting techniques in the same manner as conventional pattern compositions in the investment casting process. In short, fillers may be added to the treated composition, if so desired, and the treated composition is injected in molten state into a mold and solidified, such as by cooling, to form a disposable pattern or cast. The pattern is removed from the mold, assembled with other patterns, if necessary, and encased in a ceramic material, which upon hardening, forms a shell or cast about the disposable pattern. The disposable pattern then is then removed from the cast by application of heating. As noted in the Background section above with respect to conventional investment casting processes, a major portion of the disposable pattern is removed by melting at a moderately elevated temperature by autoclaving, with substantially all of the remainder of the pattern material being removed at a substantially higher temperature by vaporization or burning or both so that, except for any ash residue from the pattern material, the inner surface of the shell or mold is clean. The shell or mold is then ready for a one-time use for forming an investment cast part.

When used as investment casting compositions, the thermoplastic pattern-forming compositions of the present invention may be heated to free-flowing temperatures and maintained in the molten state in a reservoir for transfer to injectors The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples, all percentages are given on a weight basis unless otherwise indicated.

EXAMPLE 1

A thermoplastic material containing 0.03% by weight ash (meaning the weight of ash left in a crucible after heating compared to the weight of the starting material) that appeared red or pink to black in color and fused to the crucible was centrifuged and sent through a 20 micron cartridge filter, reducing the ash content to about 0.015 to about 0.018% by weight. The ash was still red, black and fused to the crucible.

EXAMPLE 2

A sample of the wax containing 0.026% by weight ash of high metal content was de-watered and about one part by weight ammonium citrate in warm water was mixed into 100 parts by weight of the de-watered wax. The water was dissipated from the wax, the wax filtered through a filter press and the ash content was measured as about 0.012% by weight. The ash was an orange-red color and still fused to the crucible. A second sample was treated identically, except that three parts by weight ammonium citrate was added instead of one part by weight. The resulting ash content was about 0.0068% by weight and the ash was white/gray and fluffy.

What is claimed is:

1. A method for reducing the metal content of a thermoplastic composition containing an undesirably high concentration of metal, comprising adding to 100 parts by weight of the composition at least about 0.3 parts by weight of a chelating agent and sufficient water to chelate metal in the composition to form chelated metal in the composition, and then removing at least some of the chelated metal from the composition.

2. A method as set forth in claim 1 wherein the chelated metal that is removed from the composition is removed by filtration.

3. A method as set forth in claim 2 wherein the filtration is carried out with a filter press containing cellulose fiber.

4. A method as set forth in claim 2 wherein the filtration is carried out with a filter press containing diatomaceous earth.

5. A method as set forth in claim 1 wherein about 0.3 to about 0.6 parts by weight of the chelating agent are added to the 100 parts by weight of the composition.

6. A method as set forth in claim 1 wherein the chelating agent is a metal-free chelating agent.

7. A method as set forth in claim 6 wherein the chelating agent is ammonium citrate.

8. A method as set forth in claim 7 wherein the ammonium citrate is added in the form of an aqueous mixture to the composition.

9. A method as set forth in claim 1 wherein the amount of water is at least about 1 part by weight per 100 parts by weight of the composition.

10. A method as set forth in claim 1 wherein the amount of water is at least about 2 part by weight per 100 parts by weight of the composition.

11. A method for reducing ash formation during an investment casting process with a thermoplastic composition containing metal, comprising:

(a) adding to 100 parts by weight of the composition at least about 0.3 parts by weight of a chelating agent and sufficient water to chelate metal in the composition to form chelated metal in the composition;

(b) removing at least some of the chelated metal from the composition to produce a thermoplastic composition of reduced metal content; and (c) injecting the thermoplastic composition of reduced metal content into in a mold to form a cast, which is then used for form a shell for forming an investment cast part.

12. A method as set forth in claim 11 wherein the chelated metal that is removed from the composition is removed by filtration.

13. A method as set forth in claim 12 wherein the filtration is carried out with a filter press containing cellulose fiber.

14. A method as set forth in claim 12 wherein the filtration is carried out with a filter press containing diatomaceous earth.

15. A method as set forth in claim 11 wherein a filler is added to the thermoplastic composition of reduced metal content prior to injecting it in a mold.

* * * * *